US005941467A

United States Patent [19]

McArdle et al.

[11] Patent Number: 5,941,467

[45] Date of Patent: Aug. 24, 1999

[54] SYSTEM AND METHOD FOR REDUCING MATERIAL

[76] Inventors: Matthew J. McArdle, 4832 Reno Rd. NW., Washington, D.C. 20008-2946; Robert A. Paul, 1491 Cherry Valley Turnpike, Skanateles, N.Y. 13152

[21] Appl. No.: 08/926,440

[22] Filed: Sep. 10, 1997

[51] Int. Cl.[6] ..... B02C 13/06

[52] U.S. Cl. ..... 241/5; 241/187; 241/191; 241/195; 241/275

[58] Field of Search ..... 241/294, 60, 5, 241/275, 56, 187, 188.1, 191, 195, 194

[56] References Cited

U.S. PATENT DOCUMENTS

| | | | |
|---|---|---|---|
| 50,115 | 9/1865 | Goodwin | 241/187 |
| 112,059 | 2/1871 | Mallory | 241/187 |
| 410,247 | 9/1889 | Kimble . | |
| 430,646 | 6/1890 | Hickey . | |
| 629,262 | 7/1899 | Lombard . | |
| 1,457,693 | 6/1923 | Dorn . | |
| 3,973,735 | 8/1976 | Ito et al. | 241/187 |
| 4,082,231 | 4/1978 | Gould . | |
| 4,240,590 | 12/1980 | Lautenschlager et al. | 241/188.1 |
| 4,973,005 | 11/1990 | Haesebrouck et al. . | |
| 5,100,070 | 3/1992 | Montgomery, Sr. . | |
| 5,341,753 | 8/1994 | Russell . | |
| 5,400,977 | 3/1995 | Hayles, Jr. . | |
| 5,544,826 | 8/1996 | Klingler et al. . | |

FOREIGN PATENT DOCUMENTS

| | | | |
|---|---|---|---|
| 1221082 | 7/1966 | Germany | 241/187 |
| 3345754-A1 | 6/1985 | Germany . | |
| 685167 | 12/1952 | United Kingdom | 241/187 |

OTHER PUBLICATIONS

World Coal, "Co–Firing, Friend or Foe?", Environment Focus, Dec. 1996, 6 pages.

Ronald R. Bevan, "Size Reduction", Kennedy Van Saun Corporation, Danvill, PA, Youghiogheny and Ohio Coal Company, St. Clairsville, Ohio, pp. 173–208.

*Primary Examiner*—Mark Rosenbaum

*Attorney, Agent, or Firm*—Dickstein Shapiro Morin & Oshinsky LLP

[57] ABSTRACT

A pulverizing system for reducing the size of material including a body, a pair of rotating members at least partially disposed within said body, and at least one impeller arm attached to each of said rotating members. The impeller arm attached to one of the rotating member throws material into a substantially head-on collision with material thrown by the impeller arm attached to the other rotating member.

9 Claims, 10 Drawing Sheets

SYSTEM AND METHOD FOR REDUCING MATERIAL

BACKGROUND OF THE INVENTION

1. Field of Invention

The present invention relates to pulverizers and mixers. Specifically, the present invention relates to crushers, grinders and mixers of the type designed to process coal, biomass material, and other materials.

2. Description of Related Art

The need for renewable energy sources and the creation of equipment capable of producing a marketable fuel has been increasing dramatically. In the last few years, local, state, and federal regulators have made two primary changes in the laws affecting energy producers using renewable sources. First, tougher clean air standards under the federal Clean Air Act and state laws restrict the type of materials a fuel can emit when burned. Second, the federal government has deregulated the ways in which power may be marketed. This deregulation offers energy producers greater incentive to maximize their power output within the emission limits.

Not surprisingly, current research and development for many different fuel types has focused on methods and products which would enable producers to increase energy output without exceeding present environmental standards. One fuel alternative, which has been found to meet environmental standards, mixes coal with wood or other biomass materials to create a hybrid fuel. Current equipment for commingling materials (i.e., crushers, grinders, and mixers) is generally not considered effective due to several problems in the breaking down of the biomass material: inability of such equipment to handle different material types, improper mixing techniques, inability to produce a product whose particle's size has a distribution that is advantageous for combustion, and the unacceptably high amounts of energy consumed in preparing the fuel. If such problems were overcome, biomass fuel, such as wood, would be a viable alternative capable of increasing power production under the current clean air standards.

Although crushers, grinders and mixers have been around for over a century, these types of devices are unable to grind biomass material finely enough to be used in power plants. To solve this problem, conventional reduction systems often require the material to pass through several stages to reach its final size as a result of the size limitations of the crushing machines and their internal parts. Such solutions add substantial expense to fuel preparation, and yield the array of problems listed previously.

One type of crusher and grinder design provides a chamber with pivoting arms mounted on a shaft. The arms accelerate material into the machine wall, the collision with which breaks the material. Another type of crusher or grinder uses pivoting hammers on a first shaft, which usually intermesh with hammers of a second shaft, to break the material by slamming into it. See U.S. Pat. Nos. 629,262, 4,082,231, and 4,973,005. Both designs are inefficient as a result of the significant wear on internal parts of the machine. This wear makes the machines prone to breaking and maintenance and results in significant downtime for parts replacement. Furthermore, wear causes losses in machine efficiency because devices having worn parts consume more power to perform their functions. Interdigitating designs especially suffer excessive wear because material is crushed between the meshing arms. In addition, machines relying on physical contact with machine parts to reduce the size of the material produce particles of uneven size that have sharp edges. These types of design also increase the temperature of the material significantly because the collisions with machine parts create friction. In addition, in order for these machine to maintain a certain capacity, the exit temperature of the material must be over one hundred and fifty degrees Fahrenheit. This exit temperature is too high for certain low combustion temperature materials.

Other pulverizing designs rely on cyclonic turbulence to reduce the size of material. Cyclonic turbulence may be created by the rotation of two shafts in the same direction to produce two fluid streams traveling in opposite directions in between the two shafts. The opposite forces acting on the material located in between the shafts causes the material to collide with each other and consequently break. Some designs using cyclonic turbulence also rely on the material's colliding with the parts of the machine and like material in order to complete the reduction. See U.S. Pat. Nos. 410,247, 430,646, and 1,457,693. These designs, however, do not effectively use all of the force created through the inertia of particle collision. Conventional devices experience a loss in force created at the intersecting point of the two material streams because the material does not intersect directly head-on, but rather at a seventy to eighty degree angle. The most effective collision occurs when two materials streams collide at a one hundred and eighty degree angle, i.e., a head-on collision.

U.S. Pat. No. 5,400,977 discloses a pulverizing system in which drill cuttings are broken down by colliding with each other, but not through cyclonic motion. In this device, pivoting, intermeshing arms throw material into collision with material thrown by other arms. The arms are housed within a tank whose top includes two semi-circular portions through which the arms carry the material as they rotate. The collisions of material occur below the intersection of the two semi-circular portions and between the intermeshing arms. This arrangement does not maximize the amount of inertia created by the rotating arms and therefore, is not an efficient method of reducing material. This arrangement loses inertia because the collisions are not head-on, as a result of the configuration of the tank, and because the pivoting arms decelerate when they encounter the material. Furthermore, as discussed above, the intermeshing arms suffer excessive wear because some of the material is crushed between them.

SUMMARY OF THE INVENTION

The disadvantages of the prior art are overcome to a great extent by the present invention, which provides a pulverizing system which experiences little internal part wear while maximizing the inertia of flying material to reduce the size of the material.

It is an object of the invention to provide a pulverizing system that is capable of reducing material to particles having diameters of at least approximately in the seventy to eighty micron range.

It is an object of the invention to provide a pulverizing system that is portable and inexpensive to manufacture and does not require substantial amounts of energy to operate.

It is a further object of the invention to provide a pulverizing system whose parts do not wear as rapidly as those of devices in the prior art.

It is another object of the invention to provide a pulverizing system that is capable of receiving dissimilar materials or varying sizes and produce a fuel source whose particles have a predictable size and a substantially uniform distribution of sizes.

It is a further object of the invention to provide a pulverizing system that reduces the size of material without increasing the material's temperature substantially.

It is another object of the invention to provide a method for reducing material in which head-on collisions of the material with other material in part cause the reduction.

It is another object of the invention to provide a method for reducing material in which the operator may select and regulate the size of the finished product.

It is a further object of the invention to provide a pulverizing system that reduces the size of large materials in the same amount of time as smaller materials in a single pass through the system.

Other objects, features and advantages of the present invention will become apparent from the following detailed description and drawings of the preferred embodiments of the present invention.

Briefly described, the invention comprises a pulverizing system for reducing the size of material, the system including a body portion, a pair of rotating shafts partially disposed in parallel within the body, a pair of rotors attached to each of the shafts, a plurality of graduated baffles extending from the body and defining a plurality of channels therebetween, and a plurality of impeller arms fixedly attached to each of the rotors in a helical pattern and aligned with the channels. The impeller arms mounted on a first rotor throw material into a substantially head-on collision with material thrown by the impeller arms of the other rotor.

DESCRIPTION OF PREFERRED EMBODIMENTS

Figure 1:
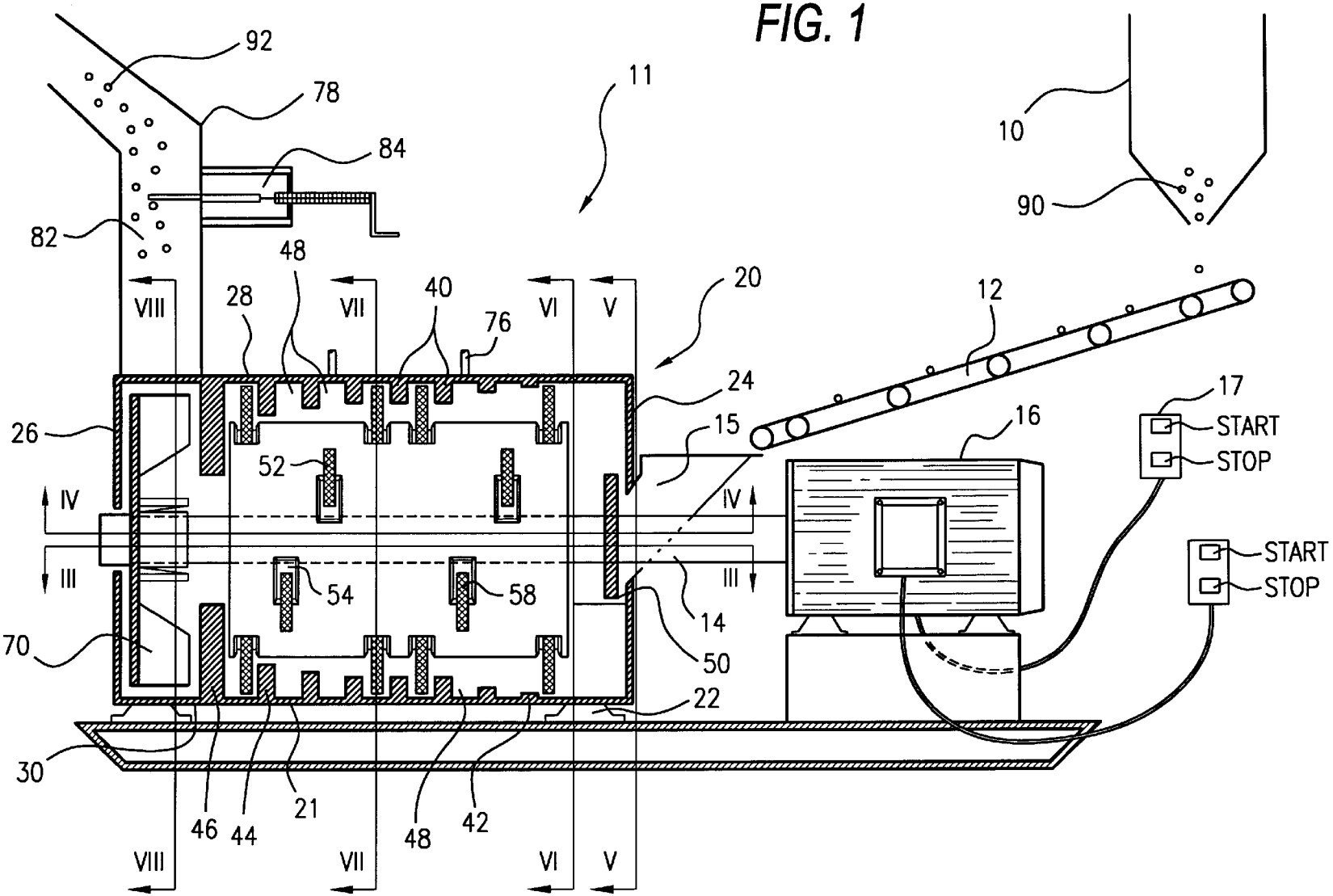
FIG. 1 is side elevation view of a preferred embodiment of a pulverizing system constructed in accordance with the present invention.

Referring now to the drawings, where like parts are designated by like reference numbers throughout, there is shown in FIG. 1 a pulverizing system 11 constructed according to the present invention. A hopper 10 holds material 90 to be reduced in size. The material in the hopper 10 can literally comprise any desired substance, including rocks, coal, wood, or biomass material. Additionally, the present invention is not solely limited to the treatment of dry material, but can also handle a slurry or slurry streams having solids that require reduction. The material 90 travels down a conveyor belt 12 into a chute 15. The chute 15 is attached to a pulverizing machine body 20 at the machine body's front end 24. The machine body 20 rests on feet 22. A pipe 82 is attached to the machine body's back end 26. The material 90 flows down the chute 15 into the machine body 20 where it is processed into particles 92 of a predetermined size. The particles 92 then leave the machine body 20 through the pipe 82 and are stored in a holding bin (not shown) connected to the pipe 82.

Figure 2:
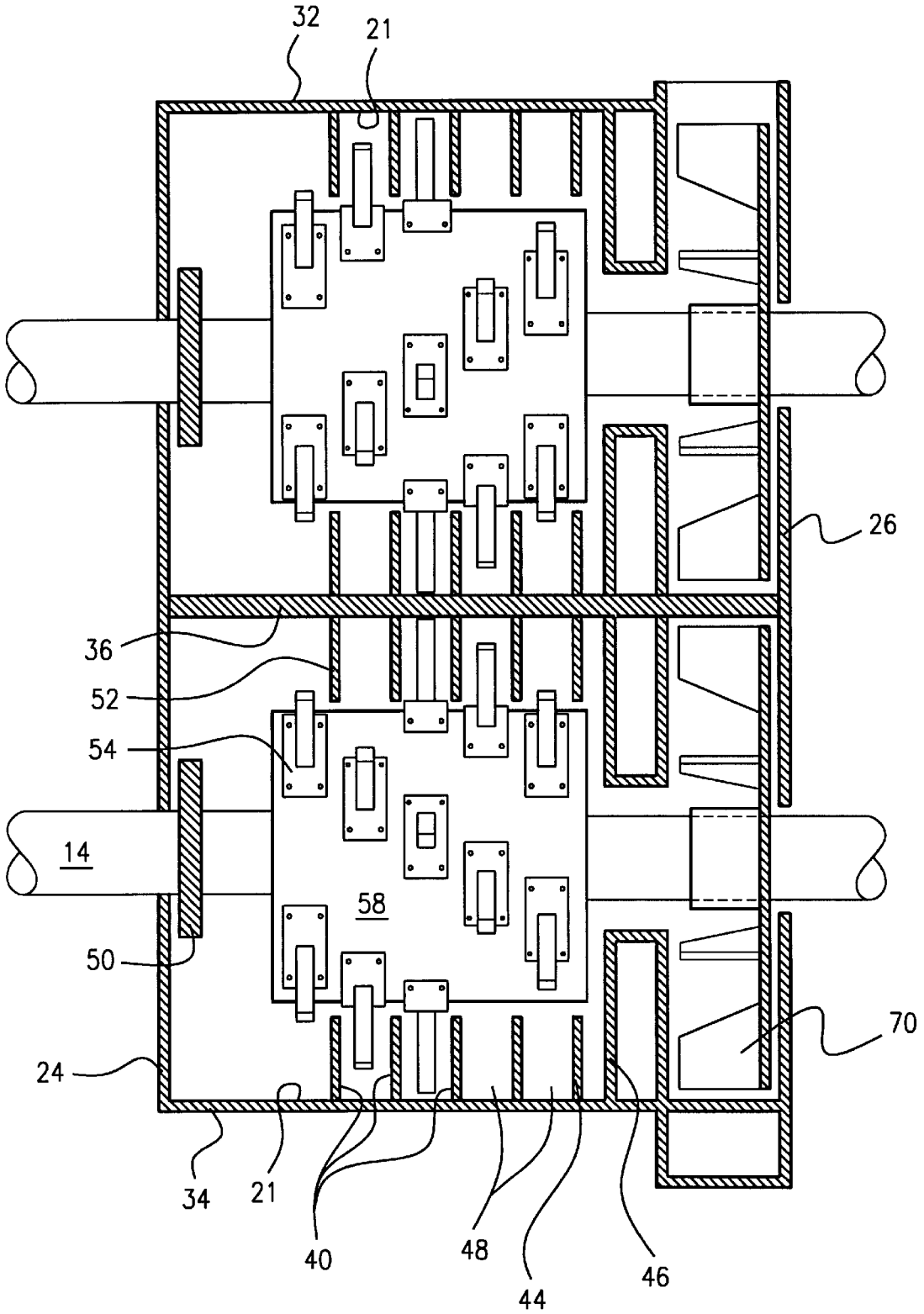
FIG. 2 is a top plan view in partial cross section of the interior of the system of FIG. 1.
Figure 6:
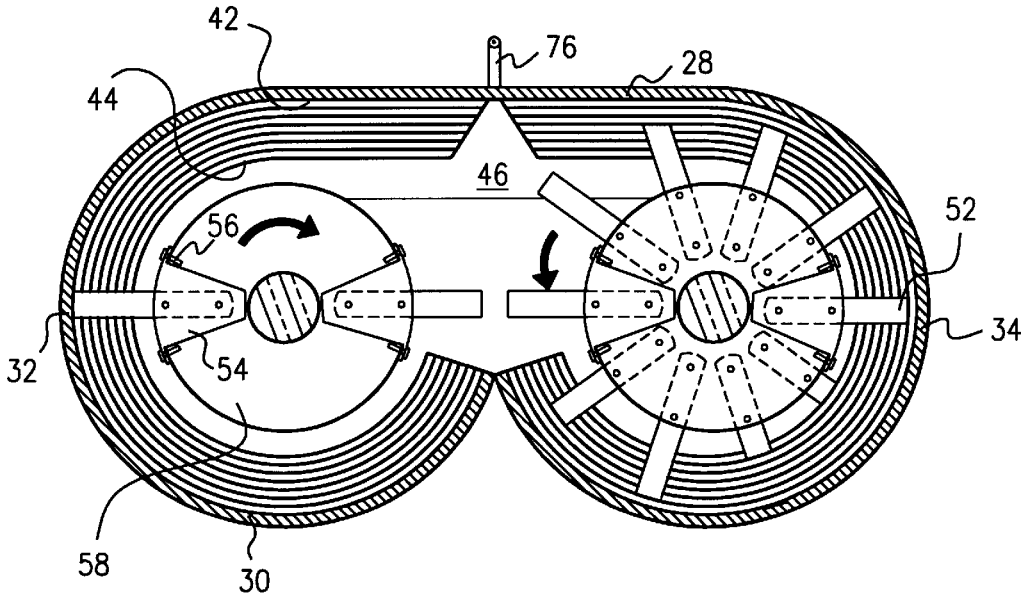
FIG. 6 is a cross sectional view taken along line VI—VI of FIG. 1.
Figure 12:
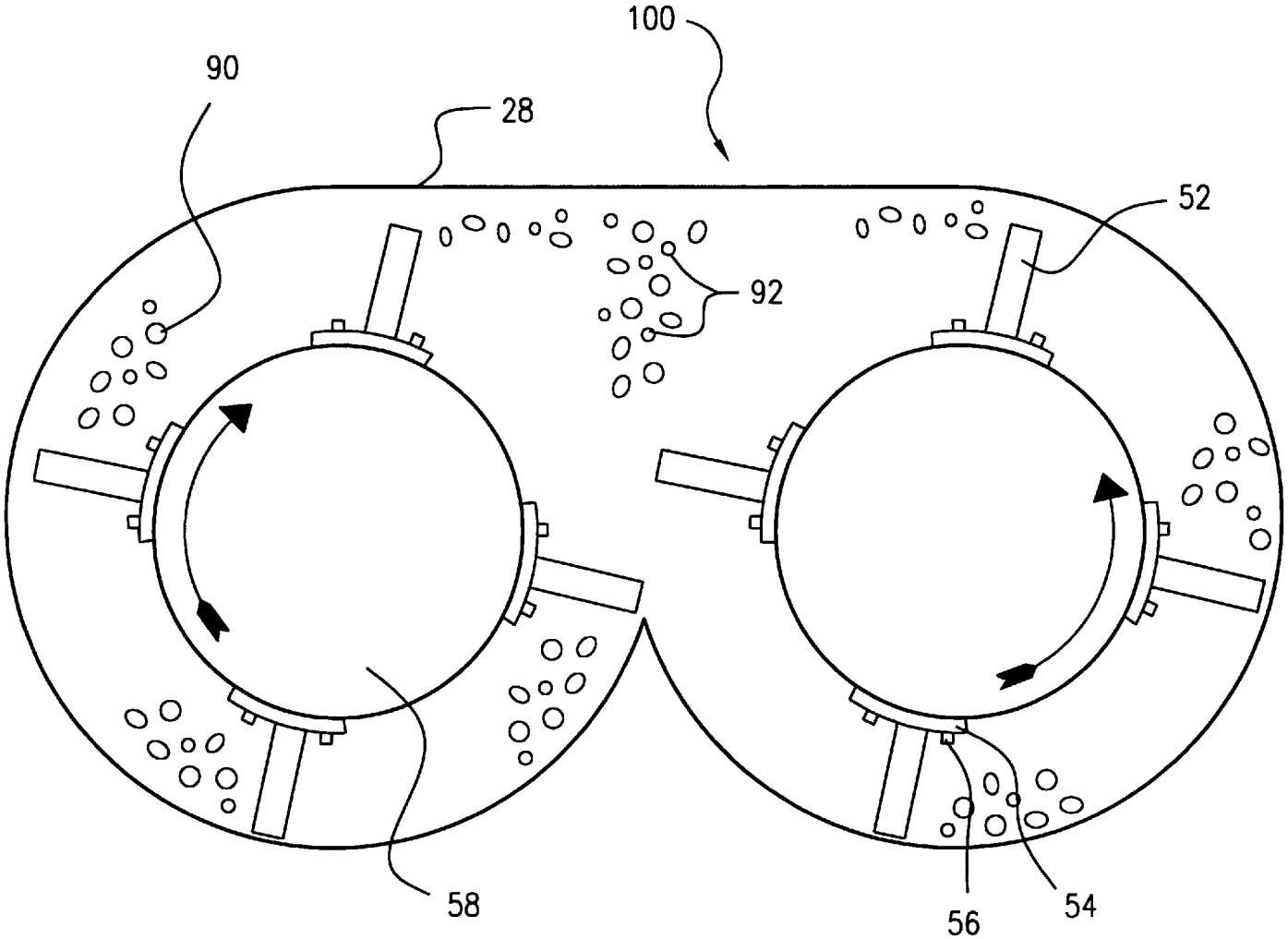
FIG. 12 is a cross-sectional view of the drums of FIG. 1 in operation.

A motor 16, controlled by a control panel 17, rotates each of the shafts 14 in opposite directions, as shown in FIGS. 6 and 12. The motors 16 rotate the shafts at the same speed, which can be any preferred speed. In the current prototype, the speed is 3500 RPMs. The current prototype uses a pair of twenty horsepower motors to process five hundred pounds of coal and wood per hour. To increase production, a larger system capable of processing five tons per hour would need larger motors, such as a fifty horsepower motors. Variable motors of different strengths could be used in various sized systems depending on the amount of output required and the material's strength and hardness. Refer now to FIG. 2, showing the machine body 20. Attached to the shafts 14 proximate the front end 24 of the machine body 20 is an input flow inducer 50, which directs the material 90 coming from the chute 15 towards the rotors 58 attached to the shafts 14. The pulverizing system 11 may operate without an input flow inducer 50. Heavy materials, for example, flow into the machine body 20 without the need for direction by the inducers 50. Moreover, with proper pressure regulation, light materials also flow into the machine body 20 effectively without an inducer 50. The flow inducer 50 is particularly effective for directing wet materials. The rotors 58 have several impeller arms 52 attached to base plates 54, which are bolted to the rotors 58 so as to form collectively a helical pattern of arms 52 on the rotors 58. The impeller arms 52 are aligned to travel in channels 48 defined between adjustable graduated baffles 40 that extend from an interior wall 21 of the machine body 20 towards the rotors 58. As a result, material flows through and over the baffles 40 from the front end 24 of the machine body 20 to the back end 26. The channels 48 may include replaceable, wear resistance liners (not shown) made of high strength ceramic material or hardened steel, which can be mounted on the baffles 40 and the interior wall 21 of the machine body 20. These liners improve the machine body's 20 resistance to wear and thus prolong the life of the machine body 20.

The impeller arms 52 lift material 90 out of the channels 48 and throw the material 90 into collision with material 90 thrown by opposing impeller arms 52. The impeller arms 52 are fixed to the rotor 58 such that they do not pivot because fixed impeller arms 52 transmit the force provided by the rotating shafts 14 better than pivoting arms, and therefore, move the material 90 more effectively. The impeller arms 52 of one of the rotors 58 are aligned to be approximately opposite the impeller arms 52 of the other rotor 58 and do not intermesh with the opposing impeller arms 52. Because the impeller arms 52 do not intermesh or interdigitate, the material 90 streams thrown by the impeller arms 52 collide substantially head-on.

Figure 3:
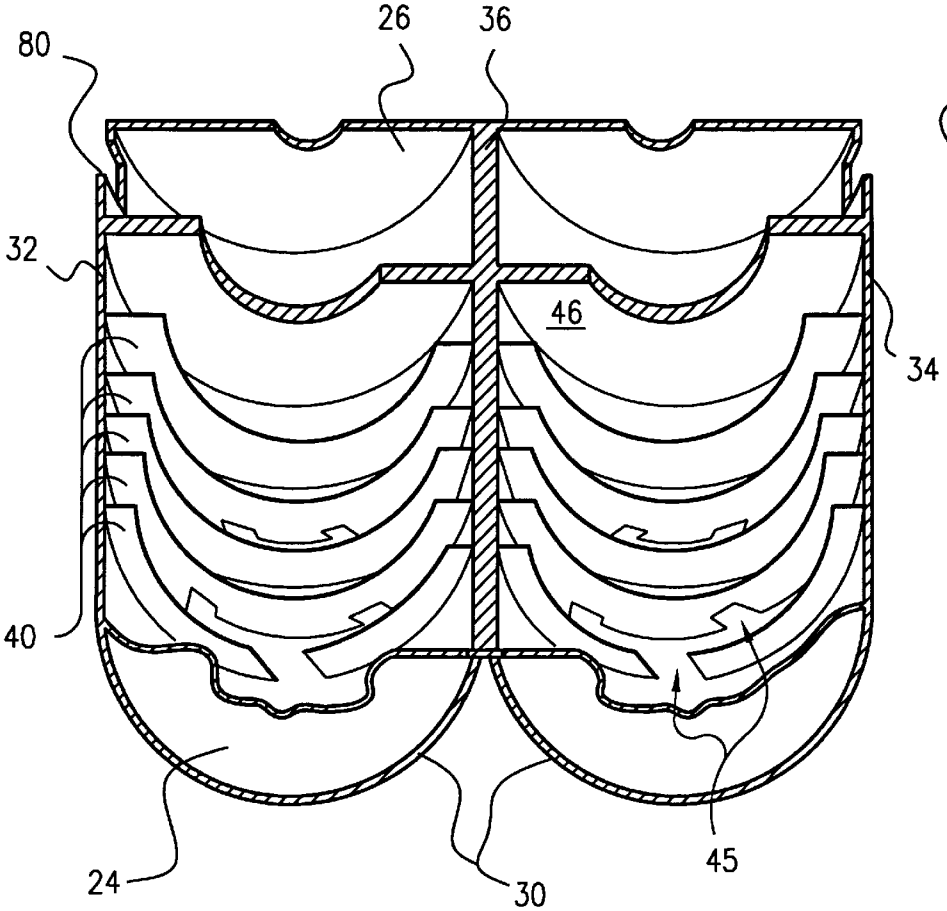
FIG. 3 is a cross-sectional perspective view taken along line III—III of FIG. 1 with the shafts and components attached thereto omitted for clarity.

Referring back to FIG. 1, there are eight graduated baffles 40 shown. The graduated baffles 40 regulate the flow of the material 90 through the machine body 20 and control particle size simultaneously. Moreover, the number and height of the baffles 40 may vary to adjust the final size of the crushed particles 92. As shown, the height of each successive graduated baffle 40 varies, with the first graduated baffle 42 being the shortest and the last graduated baffle 44 being the tallest. Taller baffles 40 prohibit larger particles from passing though. The height of each of the baffles 40 is adjustable, moreover, in order to allow the operator to select the size of the final particles. As seen in FIG. 3, the graduated baffles 40 may also include slots 45 which enable particles of a certain size to pass through the baffles 40. Particles must be of a certain size in order to pass though the slots 45. Both the graduated height of the baffles 40 and the size of the slots 45 formed therein allow particles having a sufficiently small enough size to pass towards the back end 26 of the machine body 20.

Next to the last graduated baffle 44 (FIGS. 1–2) is a discharge baffle 46, which, in a preferred embodiment, is taller than the last graduated baffle 44. The discharge baffle 46 directs the material towards the discharge device 70, which, in a preferred embodiment, is a fan. The pulverizing system may operate without a discharge device 70 if the pressure in the machine body 20 is controlled to regulate the flow of particles 92 from the machine body 20, for example, with a blast gate 84. The longer the material 90 remains in the machine body 20, the smaller the final particle size will be.

Figure 8:
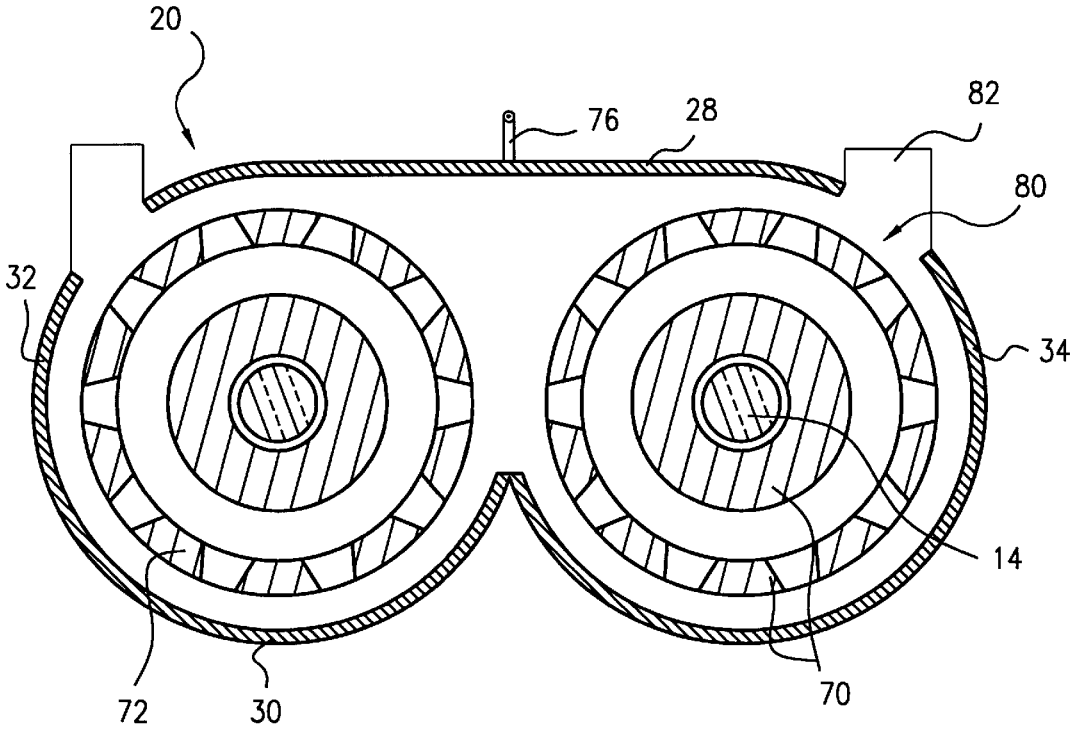
FIG. 8 is a cross sectional view taken along line VIII—VIII of FIG. 1.

FIG. 3 shows that the bottom of the machine body 20 includes two semi-circular portions 30, joined by a center wall 36. FIG. 3 also shows one location for the exit ports 80, which is in the first 32 and second circular sides 34 of the bottom half of the machine body 20, between the discharge baffle 46 and the back end 26. The exit ports 80 could be located in the bottom of the machine body 20 or in the top half of the machine body 20 (as seen in FIG. 8), and their number could vary. The exit ports 80 may be connected to a pipe 78 (FIG. 1) or a holding bin (not shown).

Figure 4:
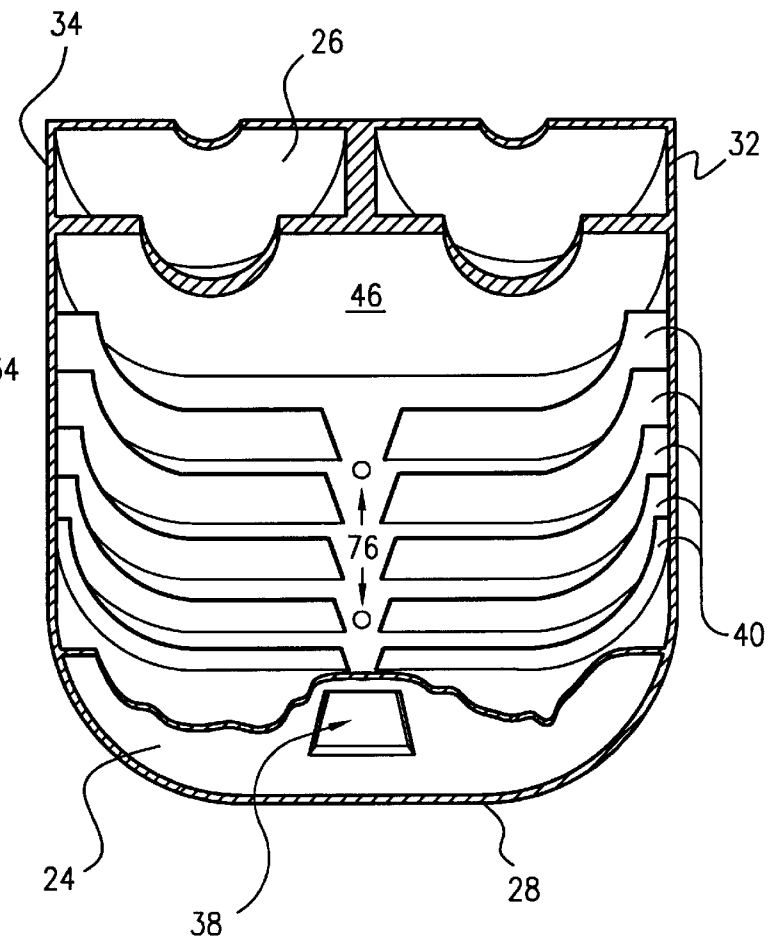
FIG. 4 is a cross-sectional perspective view taken along line IV—IV of FIG. 1 with the shafts and components attached thereto omitted for clarity.

FIG. 4 shows that the machine body 20 has a substantially flat top 28. The graduated baffles 40 running along the machine body top 28 are not continuous, but rather break at the center. This break is aligned with the inlet opening 38 in the machine body 20, which receives the chute 15. The baffles 40 may be continuous, however, to assist in increasing the retention time of the material and direct the material into a more controlled substantially head-on collision. Injection nozzles 76 may also be located at any point on the machine body 28, and are shown in FIGS. 1 and 4 located in the center of the machine body top 28. The injection nozzles 76 inject additives into the material mixture during processing. For example, it is possible to reduce the amount of environmentally harmful toxins produced during combustion of some coals by adding chemicals to the coal mixture before combustion. Chemicals are also injected in gold or other mineral bearing ores to assist in extracting gold or other minerals from the ores. The injection nozzles 76 allow chemicals to be added into the particle mixture during reduction. In addition, injection nozzles 76 can be used to add waste eating microbes to contaminated soil at hazardous waste sites or to mix fertilizers into agricultural soil that has been depleted from continual farming.

Figure 5:
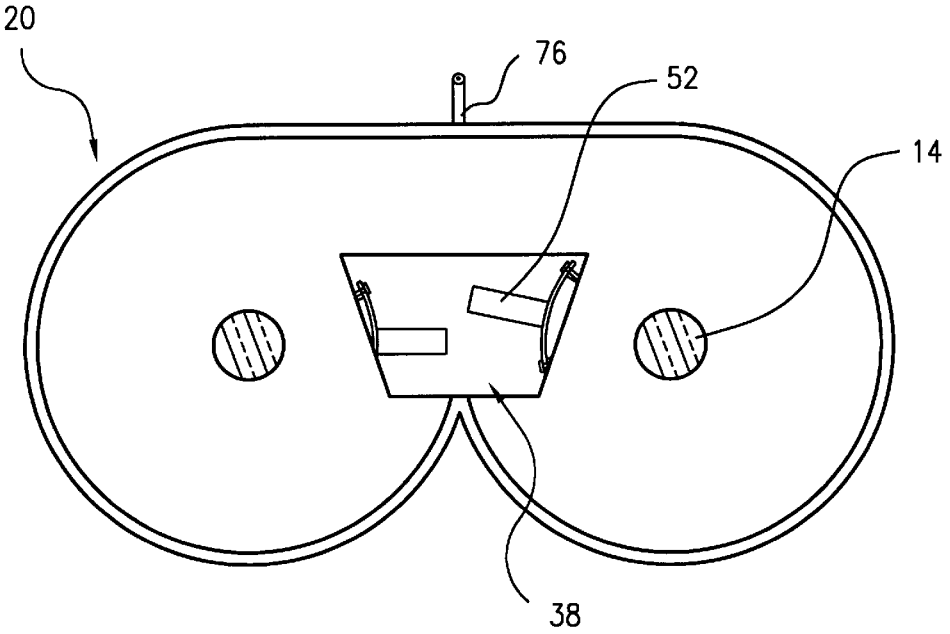
FIG. 5 is a cross sectional view taken along line V—V of FIG. 1.
Figure 7:
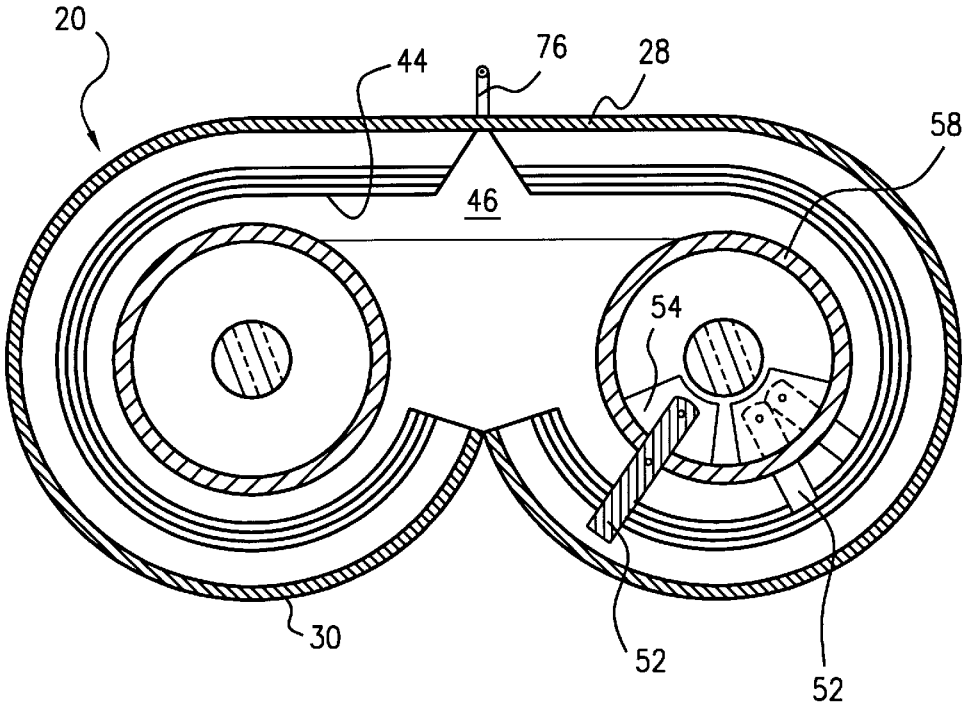
FIG. 7 is a cross sectional view taken along line VII—VII of FIG. 1.

FIGS. 5–8 show several cross-sections of the pulverizing system 11. As seen in FIG. 5, the inlet opening 38 is located in the center of the machine body 20, which allows the material 90 to enter the machine body 20 between the two rotors 58. FIG. 6 shows the eight graduated baffles 40 of FIG. 1, of which the first graduated baffle 42 is the shortest and the last graduated baffle 44 is the tallest. FIGS. 6 and 7 show that the impeller arms 52, arranged in a helical pattern, travel between the graduated baffles 40. There are fewer impeller arms 52 shown in FIG. 7 because this cross-section is taken further axially along the helical pattern of FIG. 1. In the preferred embodiment of FIGS. 6 and 7, each impeller arm 52 is supported by a base plate 54, which rests inside the hollow rotor 58. Base plate fasteners 56 secure the base plates 54 to the rotors 58.

FIG. 8 shows one type of discharge device 70, which in this embodiment, is a fan attached to each of the shafts 14. As the fans 70 rotate, the fan blades 72 draw the particle 92 flow out of the machine body 20 through the exit ports 80 (see FIG. 1). In FIG. 8, the exit ports 80 are located in the first 32 and second rounded sides 34 of the top half of the machine body 20. Pipes 82 may be attached to the exit ports 80 to receive the flow of crushed particles 92. The pulverizing system does not require a fan or discharge device 70. For example, when the particles 92 may be moved solely by regulating the pressure inside the machine body 20 with a blast gate 84 (FIG. 1) or another pressure regulating device, a fan 70 would not be necessary.

Figure 9:
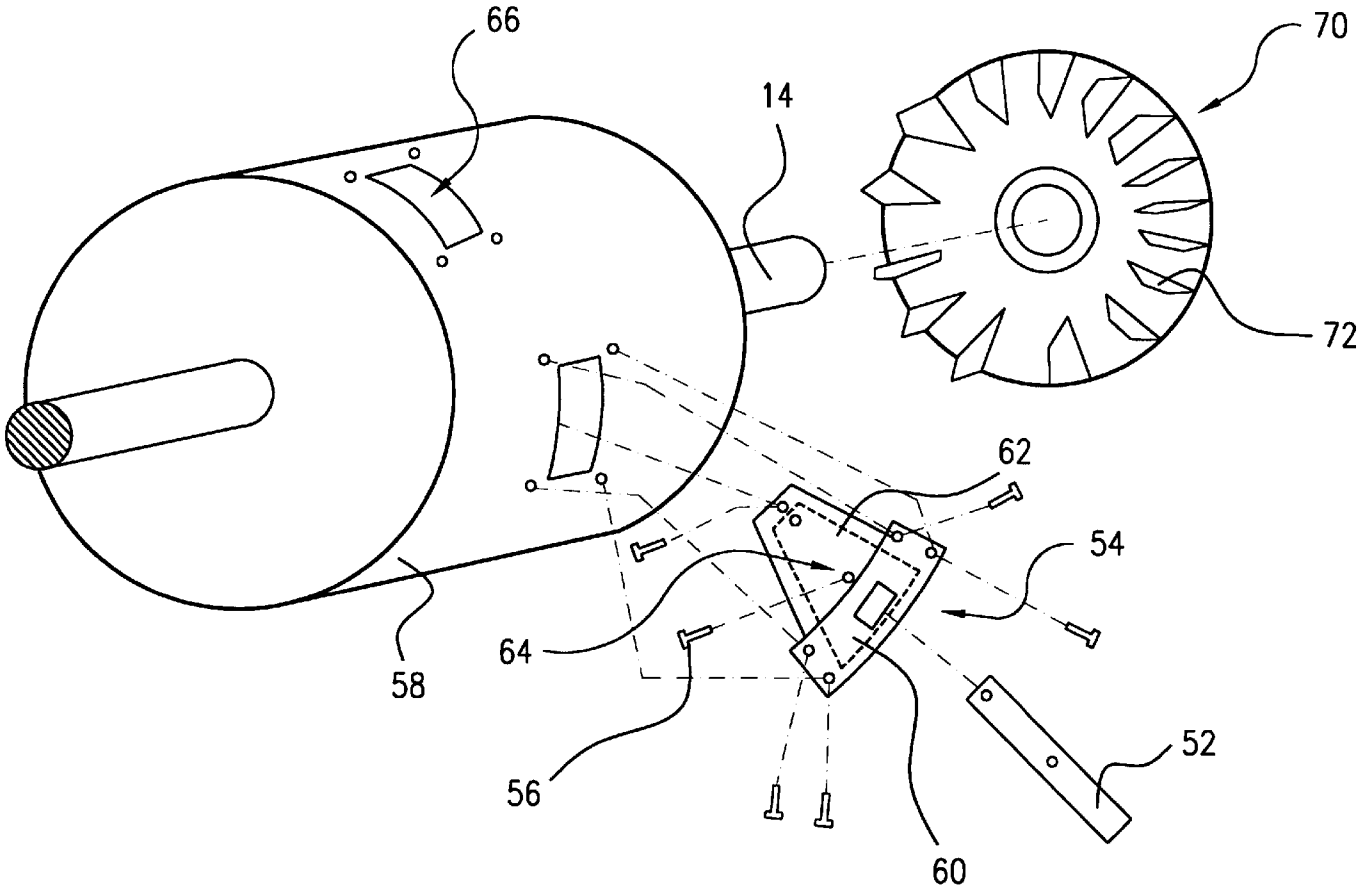
FIG. 9 is an exploded perspective view of one of the drums of FIG. 1.
Figure 10:
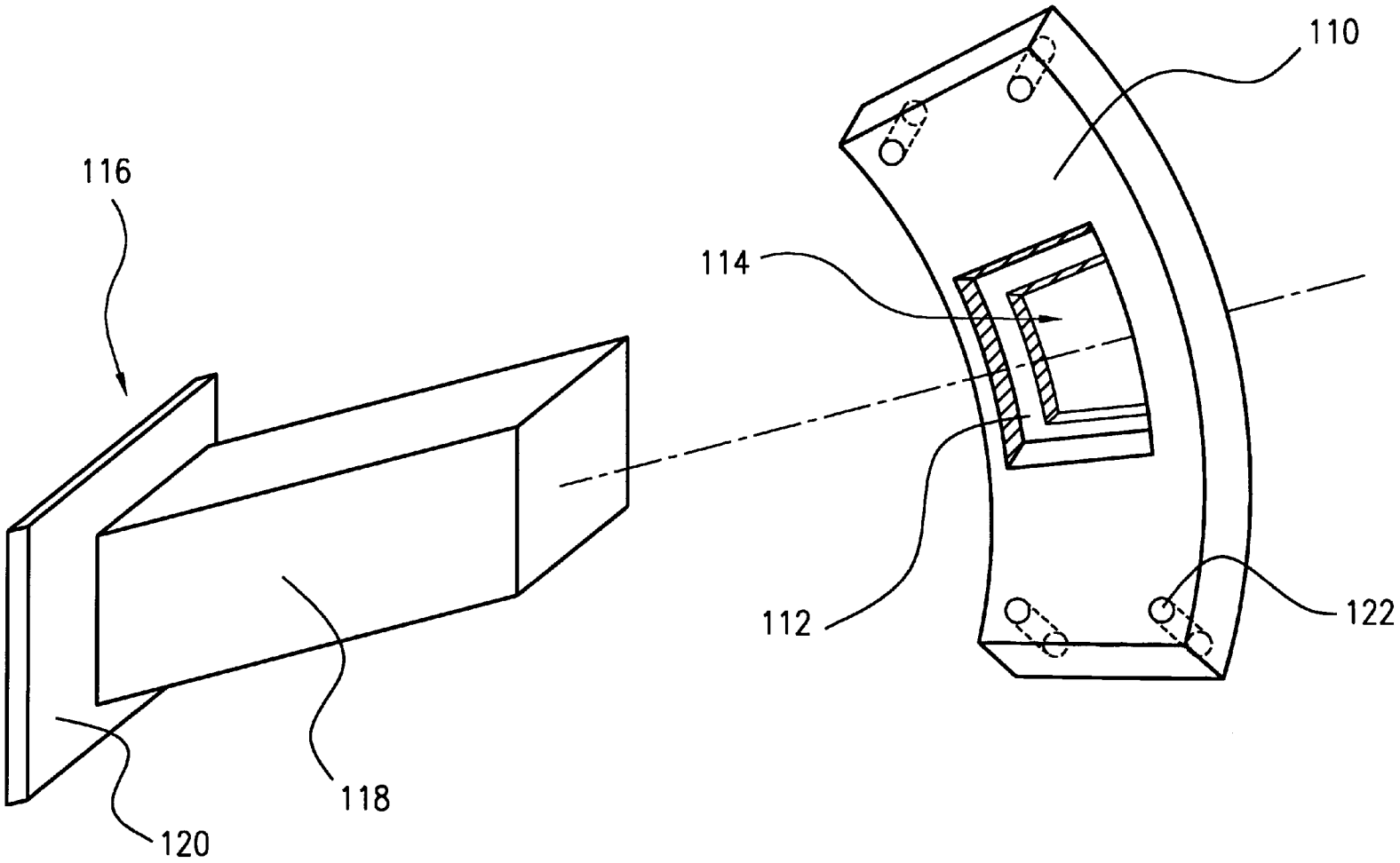
FIG. 10 is an exploded perspective of another embodiment of an impeller arm assembly used with the pulverizing system of FIG. 1.
Figure 11:
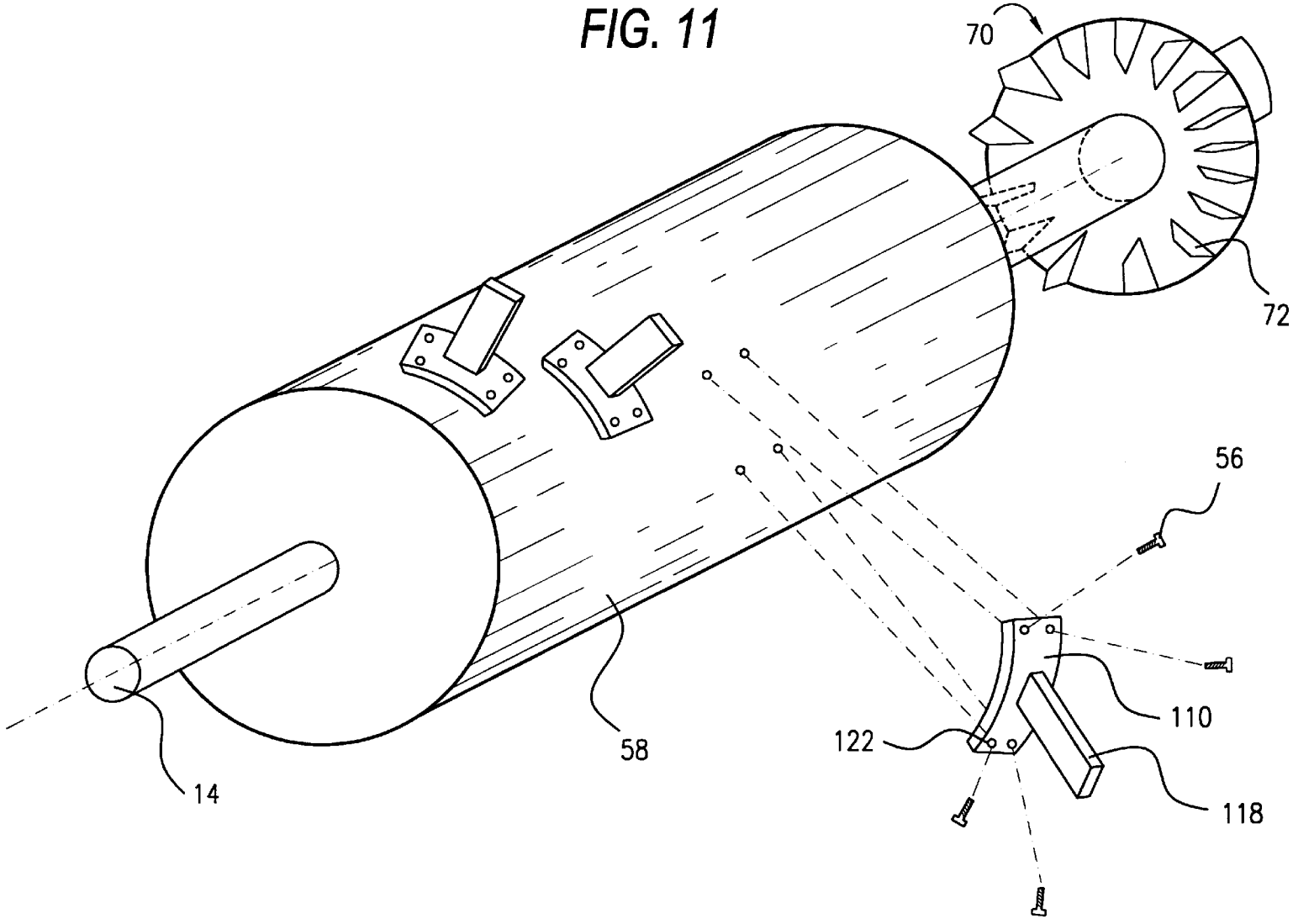
FIG. 11 is a view like FIG. 9 in which the rotor has the impeller assembly of FIG. 10.

FIGS. 9–11 show two embodiments of impeller arm 52 assemblies. In FIG. 9, a base plate 54 receives the impeller arm 52. The base plate 54 includes a base plate face 60 from which a base plate stem 62 extends. The impeller arm 52 is inserted into the base plate 54 and is secured to the base plate stem 62 with base plate fasteners 56, which are inserted into fastener holes 64 located in the base plate stem 62. The fixed impeller arms 52 thus are held rigidly to the rotor 58 and are not able to pivot. In this embodiment, several pilot holes 66 are formed within the hollow rotor 58 and are arranged in a helical pattern. The base plates 54, with the impeller arms 52, are then inserted within the pilot holes 66 and are secured to the rotor 58 with fasteners 56.

FIGS. 10–11 show an alternative way to attach the impeller arms 52 to the rotor 58. In this embodiment, the impeller arm 116 includes an impeller arm base 120 from which an impeller arm stem 118 extends. The impeller arm 116 is inserted within a hole 114 of a mounting plate 110. The mounting plate 110 includes a recess 112 having a substantially flat receiving surface sized to receive the impeller arm base 120. The impeller arm base 120 is welded into the recess 112 or otherwise secured such that the impeller arm 116 does not pivot. The mounting plate 110 is then secured to the outer surface of the rotor 58 with fasteners 56 that pass through fastener holes 122 in the mounting plate 110. Alternative methods of securing the mounting plate 110 to the rotor may be used as long as the impeller arm 116 does not pivot. The mounting plate 110 has substantially the same curvature as the rotor 58 so that it is flush against the rotor 58.

In operation, the operator selects a predetermined size for the crushed particles 92 and adjusts the height of the baffles 40 accordingly. In addition, the operator determines the length of time that the material 90 to be reduced should remain in the machine body 20 and adjusts the pressure inside the machine body accordingly. This pressure adjustment may be changed while the pulverizing system 11 is operating based on the size of the particles 92 exiting the machine body 20. The operator then allows material 90 to flow from the hopper, along the conveyor 12, down the chute 15, and into the machine body 20. The material 90 falls inside the first channel 48 or the first few channels 48, where the impeller arms 52 scoop it up. The impeller arms 52 carry the material 90 as they rotate and throw the material 90 into a substantially head-on collision with material 90 thrown by impeller arms 52 located on the opposing rotor 58. The combined speed of the material flows upon collision is approximately two hundred and forty miles per hour in a preferred embodiment. FIG. 12 shows that the collision location 100 is in the space defined by the machine body top 28 and the two rotors 58. More specifically, the substantially head-on collisions 100 occur proximate the body top 28. The broken pieces then drop into the channels 48. The impeller arms 52 continue to pick up the broken material and throw it at similar material until the material is of a predetermined size, at which point the particles 92 pass to the next channel 48 from the machine body 20 by the discharge device 70 or a pressure differential. The particles 92 then travel through the pipe 82 into a holding bin (not shown).

The material is moved though the machine body 20 by the helical nature of the impeller arms 52 and the pressure differential within the body 20. The graduated baffles 40 and the discharge baffle 46 serve to regulate the flow based upon the desired size of the crushed material. Upon entering the machine body 20, the material 90 has a first size. After the first set of collisions, the material has a second, smaller size. The helical configuration of the impeller arms 52 draw the material towards the back end 26 of the machine body 20 much like an agricultural auger moving grain or other powdered materials. If the broken particles are too large, the height of graduated baffles 40 and the size of the slots 45 within the graduated baffles 40 prevent the broken particles from advancing past a certain point. The broken particles are then carried by the impeller arms 52 to another collision. Once the particles created by the collisions are small enough, the pressure differential will draw them towards the back end 26 of the machine body 20 and over the graduated baffles 40 and the discharge baffle 46. The pressure within the machine body 20, therefore, prevents the material 90 from becoming too small. The net result of this arrangement is a smoother flow of material than in conventional devices relying on collisions with parts of the machine or cyclonic turbulence.

The pulverizing system reduces material to a predetermined size in a single pass through the machine body 20. Utility companies typically require at least seventy percent of a combustion mixture to pass through a two hundred mesh sieve. Under this standard, at least seventy percent of the mixture must have a particle size less than seventy-four microns. The pulverizing system 11 is capable of producing mixtures that meet this standard. For example, the current prototype has reduced a mixture of seventy percent coal having a top size of one inch by one inch and thirty percent wood having a top size of two inches by one inch to meet this standard in a single pass through the system in approximately two seconds or less. The pulverizing system is also capable of reducing to a predetermined particle size relatively large materials whose top size is about four by four inches in the same amount of time as it reduces smaller materials whose top size is about one-fourth by one-fourth inches in a single pass through the system. As a result, the capacity of the pulverizing system is not decreased significantly when larger top size material is processed.

Because the collision of the material happens in the neutral space between the rotors, there is less wear on the internal parts of the system. In addition, because the machine parts experience less wear, the pulverizing system does not consume additional power to compensate for worn parts, which makes the pulverizing system more efficient. The central location 100 of the collisions results in little accumulation of material below either rotor 58, which would cause drag on one the shafts and thus reduce the efficiency of the system. The colliding material 90 also experiences less rise in temperature due to breakage than that produced by the friction created when material collides with parts of the machine and is as equally effective when the temperature of the exit material is below one hundred and fifty degrees Fahrenheit. This ability allows the pulverizing system to process materials at lower temperatures, which is advantageous when the material has a low combustion temperature.

Figure 13:
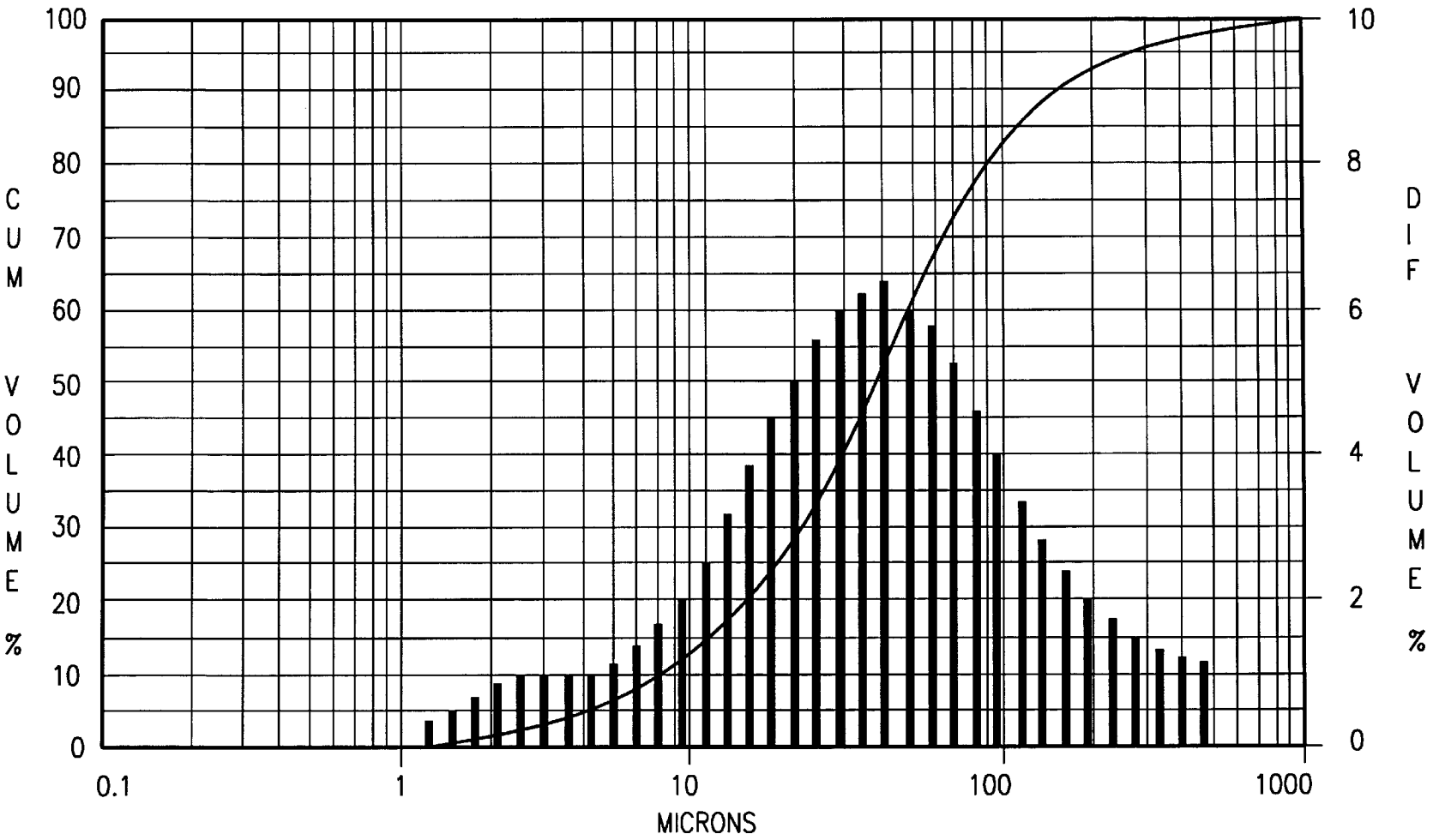
FIG. 13 is a graph showing the distribution of reduced particles by size.

The substantially head-on collisions, furthermore, produce more spherical particles than conventional devices because the impact of the material with other flying material weakens and dissolves the natural bonds between the molecules. Spherically-shaped particles burn more evenly and leave less residue in the combustion chamber. Therefore, mixtures processed by the pulverizing system 11 are attractive to power plants. Moreover, the distribution of particle size is more uniform. FIG. 13 shows the results of a Microtrac test conducted by the Department of Energy. Wood and coal of various sizes were fed into the pulverizing system to produce a mixture of wood and coal particles. The mixture was seventy percent coal and thirty percent wood. FIG. 13 shows that the distribution of particle size has approximately a Bell curve with the median particle size being approximately 40 microns. The largest particles were about 500 microns and the smallest particles about 1.5 microns. A uniform particle size distributions advantageous because it enables the operator to select a predetermined size with greater accuracy. In addition, utility companies prefer mixtures having a uniform particle size distribution because these mixtures yield better combustion results.

The pulverizing system is useful for crushing coal, wood, biomass material, tires, and waste such as municipal solid waste, agricultural waste, and hospital and pharmaceutical waste, all of which may be burned to produce power. In addition, the pulverizing system is capable of mixing different materials, such as wood and coal, and injecting additives to the mixture to improve its combustion characteristics. The pulverizing system could also be used to grind construction and demolition debris on site, which could then be reused in asphalt. The pulverizing system could be used to crush glass, plastic, china, limestone, silicon chips, gypsum board, carbon, used utility poles and railroad ties, and hazardous materials. The pulverizing system could also be used in mining operations to reduce ore and tailings as well as to recover minerals.

The above description and drawings are only illustrative of preferred embodiments of the present invention, and are not intended to limit the present invention thereto. Any modification of the present invention which comes within the spirit and scope of the following claims is to be considered part of the present invention.

What is claimed is:

1. A pulverizing system for reducing the size of material comprising:

a body;

a pair of rotating shafts partially disposed in parallel within said body;

a pair of rotors attached to each of said shafts;

a plurality of graduated baffles extending from said body and defining a plurality of channels therebetween; and a plurality of impeller arms fixedly attached to each of said rotors in a helical pattern and aligned with said channels;

wherein at least one of the plurality of impeller arms attached to one of said pair of rotors throws material into a substantially head-on collision with material thrown by at least one of the plurality of impeller arms attached to the other of said pair of rotors.

2. The pulverizing system of claim 1 wherein said body has a substantially flat top; and wherein said substantially flat top and said rotors define a collision space in which said substantially head-on collisions occur.

3. The pulverizing system of claim 1 wherein said impeller arms are non-interdigitating.

4. The pulverizing system of claim 1 wherein said body has an inlet, and a pair of exit ports; and wherein said graduated baffles including a first graduated baffle proximate said inlet and a second graduated baffle disposed between said first graduated baffle and said pairs of exit ports, wherein the height of said second baffle is greater that the height of said first baffle, and wherein at least one of said baffles include at least one slot sized to allow particles of a predetermined size to pass though said baffle.

5. The pulverizing system of claim 4 wherein said body has a rounded first side, a rounded second side, and a bottom including two semi-circular portions joined by a center wall.

6. The pulverizing system of claim 1 wherein said rotor further comprises:

a hollow cylindrical housing having a series of pilot holes defined therein and arranged in a helical pattern; and a plurality of base plates sized to fit within said pilot holes and each including a base plate stem and a base plate face;

wherein each base plate stem has a recess defined therein and sized to receive a portion of one of said impeller arms and said base plate faces are fastened to said housing.

7. The pulverizing system of claim 1 wherein said rotor includes a cylindrical housing and said impeller arms each include an impeller arm base and an impeller arm stem extending from said impeller arm base; and further comprising a plurality of base plates fastened to said housing in a helical pattern, each base plate including a recess sized to receive one of said impeller arm bases;

wherein each of said impeller arm bases is fixedly attached to one of said base plates.

8. A pulverizing system for reducing the size of material comprising:

a body having a substantially flat top, an inlet, a pair of exit ports, a rounded first side, a rounded second side, and a bottom including two semi-circular portions joined by a center wall;

a pair of rotating shafts partially disposed within said body;

a cylindrical hollow rotor attached to each of said shafts;

a plurality of non-interdigitating impeller arms attached to each of said rotors in a helical pattern;

a plurality of graduated baffles extending from said body, said graduated baffles including a first graduated baffle proximate said inlet and a second graduated baffle disposed between said first graduated baffle and said pairs of exit ports, wherein the height of said second baffle is greater that the height of said first baffle, and wherein each of said baffles include at least on slot sized to allow particles of a predetermined size to pass though said baffle;

wherein said impeller arms are arranged to travel in channels formed between said graduated baffles;

wherein said impeller arms throw the material into collision with material thrown by opposing arms to produce crushed material;

an input flow inducer located between said inlet and said first graduated baffle, and configured to direct the material towards said rotors;

a discharge baffle which directs said crushed material out of said body;

a fan located proximate said exit ports which draws said crushed material from said body;

a plurality of feet supporting said body; and a plurality of injection nozzles secured to said body.

9. A method of reducing material comprising the steps of:

(1) dumping material of a first size into a first channel;

(2) throwing said material into a substantially head-on collision with like material with rotating impeller arms to create material of a second size;

(3) moving said second sized material to a subsequent channel;

(4) throwing said second sized material into a substantially head-on collision with like material with rotating impeller arms to create material of a third size;

(5) repeating steps (3) and (4) until a material of a predetermined size is created; and (6) removing said material of a predetermined size.

* * * * *